United States Patent [19]

Zimmer et al.

[11] Patent Number: 4,865,662

[45] Date of Patent: Sep. 12, 1989

[54] ALUMINUM-MANGANESE-IRON STAINLESS STEEL ALLOY

[75] Inventors: James M. Zimmer, Beaver, Pa.; William D. Bailey, Regina, Canada

[73] Assignee: Ipsco Inc., Canada

[21] Appl. No.: 164,055

[22] Filed: Mar. 3, 1988

Related U.S. Application Data

[63] Continuation-in-part of Ser. No. 34,486, Apr. 2, 1987, abandoned.

[51] Int. Cl.[4] ..... C22C 38/56

[52] U.S. Cl. ..... 148/329; 420/73; 420/74; 420/78; 420/80

[58] Field of Search ..... 420/72, 73, 74, 77, 420/78, 80; 148/329

[56] References Cited

U.S. PATENT DOCUMENTS 3,111,405 11/1963 Cairns et al. ..... 420/80
3,193,384 7/1965 Richardson ..... 420/79

FOREIGN PATENT DOCUMENTS 655824 1/1963 Canada .
876458 8/1961 United Kingdom .

OTHER PUBLICATIONS

S. K. Banerji; "An Update on Fe-Mn-Al Steels", Jun. 11, 1981, Published by Foote Mineral Co., Route 100, Exton, PA 19341.

S. K. Banerji; "The 1982 Status Report on Fe-Mn-AL Steels", Oct. 1, 1982, Published by Foote Mineral Co., Route 100, Exton, Pa. 19341.

J. W. Holladay; "Review of Developments Iron Aluminum Base Alloys", Jan. 30, 1961, Defense Metals Information Center, Battelle Memorial Institute, Columbus, Ohio.

L. D. Castelletti and D. Spinelli; "The Resistance to Oxidation and the Electrical Resistivity of an Fe-Mn-Al System Alloy": Univ. of Sao Paulo, Sao Carlos, Brazil; Proc. XXXVI, Brazilian Society of Metals Annual Contress, Jul. 5-10, 1981.

L. D. Castelletti and D. Spinelli; "Mechanical Properties of an Austenitic Steel of the System Fe-Mn-Al": University of Sao Paulo, Sao Carlos, Brazil, ibid, p. 299.

A. J. Bushinelli et al., "Study of Microstructural Transformations in TIG Welding of an Fe-Al-Mn Alloy", Federal University of Santa Catarina, Florianapolis, Brazil, ibid, p. 251.

K. Narasimha et al., "An Evaluation of Al-Mn-C Austenitic Steel" Submitted to Journal of Metals AIME, Warrendale, Pa.

G. S. Krivonogova et al., "Phase Transformation Kinetics in Steel 9G28Yu9MVB" Physics of Metals and Metallography (4); pp. 86-92, 1975.

V. P. Batrokov et al., "State of the Surface Layer and Corrosion Resistance of Steel 9G28Yu9MVB", Metl., 10, (5) p. 487, 1974.

M. F. Alekessenko et al., "Phase Composition, Structure, and Properties of Low Density Steel 9G28Yu9MVB", Metal Science and Heat Treatment 14, (3-4), p. 187, 1972.

*Primary Examiner*—Deborah Yee
*Attorney, Agent, or Firm*—Workman, Nydegger & Jensen

[57] ABSTRACT

An austenitic stainless steel alloy has a composition of about 6 to about 13 percent aluminum, about 7 to about 34 percent manganese, about 0.2 to about 2.4 percent carbon, 0.4 to about 1.3 percent silicon, about 0 to about 6 percent chromium, about 0.5 to about 6 percent nickel, and the balance essentially iron. The relative quantities of the foregoing elements are selected from these ranges to produce a volume percent of ferrite structure in the alloy in the range of about 1 percent to about 8 percent. The volume percent of ferrite is determined by the empirical formula $$1 < VPF = 33 + 2.6(\text{Al}\ \% \pm .08) + 5.4(\text{Si}\ \% \pm .03) - 1.6(\text{Mn}\ \% \pm .16) - 8.5(\text{C}\ \% \pm .03) - 1.2(\text{Ni}\ \% \pm .15) - 4.6(\text{Cr}\ \% \pm .17) < 8$$

16 Claims, No Drawings

ALUMINUM-MANGANESE-IRON STAINLESS STEEL ALLOY

CROSS-REFERENCE TO RELATED APPLICATION

This is a continuation-in-part of our prior application Ser. No. 034,486, filed Apr. 2, 1987, now abandoned.

FIELD OF THE INVENTION

This invention relates to the economical production of lightweight, low density, corrosion resistant iron-manganese-aluminum alloys with appropriate additions of silicon, nickel and chromium to enhance corrosion resistance, with all alloying elements balanced to result in a selectively controlled ratio of ferritic to austenitic structure.

BACKGROUND OF THE INVENTION

It is know that iron-manganese-aluminum alloys can provide steels with austenitic structure, having the desirable characteristics of low density, resistance to oxidation and cold ductility. Iron-manganese-aluminum alloys including small quantities of additional alloying elements are described in U.S. Pat. Nos. 3,111,405 (Cairns et al.) and 3,193,384 (Richardson).

However, the production of alloys of this general character having suitable properties and hot-workability to allow economical manufacture on conventional steel mill facilities requires control of the resulting cast alloy crystal structure, ie. the relative proportions of body-centered (ferritic) crystal structure and face-centered (austenitic) crystal structure in the alloy. These alloys are expected to find application primarily in plate, sheet and strip form. The hot rolling of these product forms makes the control of the proportions of ferrite and austenite particularly critical, owing to the high speeds and high rates of deformation encountered in commercial mill practices. Additionally, to provide sufficient corrosion resistance for service in the intended operating environments, economically judicious amounts of other alloying elements must be added to the base iron-manganese-aluminum alloys.

The ferrite-austenite ratio in austenitic stainless steel alloys is of critical importance to the final properties of a steel alloy, and is itself dependent upon the elemental composition of the alloy. Thus, while a high aluminum content is desirable in these stainless steel alloys to impart both superior corrosion and oxidation resistance and a lowering of density, the aluminum concentrations required to be of significant benefit in that connection result in a ferritic structure which is not readily hot-worked by conventional methods to produce marketable products. Further, a high aluminum steel product may exhibit limited formability, such that its usefulness in fabricating engineering structures is limited. It is known that the addition of manganese and carbon compensates for aluminum and promotes the conversion of the ferritic structure to an austenitic structure, resulting in superior hot workability at conventional hot rolling temperatures, as well as improved qualities of formability, ductility, and toughness.

Early investigations of iron-manganese-aluminum alloys have recognized the enhancement of properties that can be achieved by increasing the proportion of austenite structure in such products, providing recipes for such alloys but no indication as to how the ferrite-austenite ratio may be controlled by judicious selection of the elemental composition.

The applicants have found that precise control of the ratio of ferritic volume to austenititic volume is critical to the successful hot rolling of iron-manganese-aluminum alloys. It has been found that a maximum of about 8 percent of the ferrite crystal structure form is compatible with economical and efficient hot rolling of the alloys. A level of ferrite in excess of this proportion causes the workpiece to develop surface tears and "pulls", usually requiring scrapping of the product. Heretofore, the problems presented by an alloy composition having too great a proportion of ferrite structure have been addressed by the use of decreased hot rolling temperatures, but that solution comes only at the expense of increased rolling costs and rolling loads on the mill equipment. Further, the hot rolling temperature limits the final minimum size or thickness of the hot rolled product, so that with higher ferrite alloys additional cold reductions are required to obtain the requisite product sizes, with concomitant added cost and complexity in the production process.

On the other hand, if an iron-manganese-aluminum alloy having purely austenitic crystal structure forms during the solidification of a cast ingot or slab, the casting has been found to result in the development of enlarged grains during the solidification process. Again, the consequence is poor hot workability. During hot rolling, the edges of the workpiece develop irregular tears and fissures to a degree that severe edge loss is encountered in the coil or sheet, resulting in costly yield loss and in strips, sheets or coils too narrow for the intended market. For this reason, a number of hitherto available austenitic steels having too low a ferrite crystal structure have been unamenable to the modern and cost-beneficial process of continuous casting of slabs.

Attempts have been made to remedy the problems resulting from too little ferrite, by extraordinary control of the casting temperature and/or lower rolling temperatures to minimize the grain size of the casting and the enlargement of the grains during heating for rolling. However, as a practical matter, such extraordinary control requirements are seriously detrimental to good productivity and, even at best, have proved only marginally successful in preventing yield losses and offsize product.

Alloys of iron-manganese-aluminum have been found to be deficient in corrosion resistance sufficient for some intended service environments. Additions of silicon, nickel and chromium, added in proper amounts, have been found to enhance the corrosion resistance of the base alloys sufficiently to allow products of these alloys to compete with the more costly austenitic stainless steels.

SUMMARY OF THE INVENTION

The present invention provides a substantially austenitic stainless steel alloy having a predetermined volume percent of ferrite structure lying in the range of about 1 percent to about 8 percent. The alloys comprises by weight 6 to 13 percent aluminum, 7 to 34 percent manganese, 0.2 to 1.4 percent carbon, 0.4 to 1.3 percent silicon, 0 to 6 percent nickel and 0.5 to 6 percent chromium, the balance comprising iron. Preferred ranges of these elements are: 6 to 12 percent aluminum, 10 to 31 percent manganese, 0.4 to 1.2 percent carbon, 0.4 to 1.3 percent silicon, 0.5 to 4.5 percent nickel and 0.5 to 5 percent chromium. The volume percent of ferrite (VPF) structure in the alloy as a whole is selectively achieved by choosing the relative quantities of elements constituting the alloys according to the formula $$1 < VPF = 33 + 2.6(Al\%) + 5.4(Si\%) - 1.6(Mn\%) - 8.5(C\%) - 4.6(Cr\%) - 1.2(Ni\%) < 8$$

where Al%, Si%, Mn%, C%, Cr%, and Ni% are selected percentages by weight of aluminum, silicon, manganese, carbon, chromium and nickel, respectively present in the alloy, the balance of the composition of the alloy comprising iron, and where VPF is the volume percent of ferrite structure. Other elements present as impurities in small quantities will have an insignificant effect on the foregoing formula. Molybdenum and copper and other minor impurities may be present up to about 0.5%. These residual elements will have no appreciable undesirable effect on the volume percent ferrite calculated according to the foregoing formula.

The purpose of including silicon, chromium and nickel is to assure adequate corrosion resistance of the alloys for application in intended operating environments. Chromium and nickel additions up to 6 percent each and silicon up to 1.3 percent have been found to be beneficial and necessary depending on the severity of the environment.

Corrosion resistant alloys made in accordance with the present invention may be made using either chromium or nickel or both together. The above formula is applicable in all three cases.

Alloys made in accordance with the present invention must satisfy two requirements: (1) the weight percent of the alloying elements must lie within the specified ranges; and, at the same time, (2) the weight percentages of these elements must satisfy the above-stated formula.

Where it is desired that the alloys made in accordance with the present invention also have the characteristic of good weldabililty, the lower limit for VPF is 2 instead of 1, the foregoing formula being otherwise unchanged.

A principal object of the present invention is to provide austenitic stainless steel materials at relatively low cost, having low density and high strength as compared with prior austenitic stainless steel alloys, and having at the same time characteristics of good formability and hot workability permitting fabrication by currently available industrial methods.

A further object of the invention is to provide relatively low cost stainless steel alloys having resistance to oxidation and corrosion in atmospheric environments that is comparable to more costly stainless steels.

A further object of the invention is to provide a formula for specifying the elemental composition of iron-manganese-aluminum alloys with additions of silicon, nickel and chromium so that the relative proportions of ferritic and austenitic structure permit commercial production by established practices on conventional plant equipment.

A further object of the invention is to specify the concentration of silicon, nickel, and chromium in the iron-manganese-aluminum alloy base sufficient for optimum corrosion resistance in the service environments anticipated for these alloys.

Another object of the invention is to provide, at reasonable cost, low density, high strength and corrosion resistant alloys that can be readily melted, cast and rolled to produce forms and sizes for use in the fabrication of engineering structures, by conventional steel making practices and steel plant equipment.

Another object of the invention is to provide a method for making substantially austenitic stainless steel alloys having good resistance to corrosion.

DETAILED DESCRIPTION OF THE INVENTION

It has been found that by control of the ferrite-austenite ratio in stainless steels of the composition under consideration, so that the volume percent of ferrite crystal structure lies in the range of about 1 percent to about 8 percent, a very "forgiving" steel composition can be produced, which accepts both cold and hot rolling without generating the kinds of problems encountered in the prior art.

In order to study the relationship between elemental composition and the ferrite-austenite ratio, a number of small laboratory heats were melted and cast with a range of compositions as shown in Table 1 below.

TABLE 1

| | Composition Percent | | | | | | |
|---|---|---|---|---|---|---|---|
| Melt No. | C | Mn | Si | Al | Cr | Ni | VPF % |
| 1232 | .99 | 27.8 | 1.43 | 9.4 | 0 | 0 | 13.0 |
| 1295 | .99 | 28.6 | 1.43 | 9.7 | 0 | 0 | 12.7 |
| 1413 | .92 | 29.7 | 1.22 | 6.9 | 0 | 0 | 2.3 |
| 1455 | .85 | 29.1 | 1.20 | 7.7 | 0 | 0 | 2.6 |
| 1456 | .94 | 29.7 | 1.07 | 9.6 | 0 | 0 | 10.8 |
| 1563 | .82 | 34.4 | 1.30 | 10.7 | 0 | 0 | 4.1 |
| 1568 | 1.03 | 28.5 | .93 | 10.2 | 0 | 0 | 25.0 |
| 1667A | .63 | 29.3 | .75 | 9.0 | 0 | 0 | 13.6 |
| 1667B | .63 | 28.9 | .76 | 9.5 | 0 | 0 | 16.4 |
| 1667C | .63 | 29.0 | .75 | 10.0 | 0 | 0 | 15.5 |
| 1667D | .63 | 28.8 | .74 | 10.6 | 0 | 0 | 7.7 |
| 1667E | .62 | 29.3 | .75 | 10.9 | 0 | 0 | 13.4 |
| 1668A | .68 | 29.0 | .75 | 9.8 | 0 | 0 | 11.8 |
| 1668B | .68 | 28.8 | .75 | 10.1 | 0 | 0 | 8.7 |
| 1668C | .67 | 28.6 | .74 | 10.9 | 0 | 0 | 3.9 |
| 1668D | .67 | 28.2 | .74 | 11.1 | 0 | 0 | 6.3 |
| 1668E | .66 | 28.2 | .74 | 11.6 | 0 | 0 | 9.7 |
| 1671A | .90 | 28.2 | .41 | 9.8 | 0 | 0 | 6.1 |
| 1671B | .90 | 28.1 | .41 | 10.1 | 0 | 0 | 5.4 |
| 1671C | .90 | 27.9 | .40 | 10.7 | 0 | 0 | 9.3 |
| 1671D | .88 | 27.9 | .40 | 11.1 | 0 | 0 | 12.6 |
| 1671E | .90 | 27.7 | .40 | 11.5 | 0 | 0 | 17.8 |
| 1774A | .71 | 28.6 | .70 | 9.9 | 0 | 0 | 7.6 |
| 1774B | .71 | 28.0 | .69 | 10.6 | 0 | 0 | 10.9 |
| 1774C | .68 | 27.9 | .69 | 10.9 | 0 | 0 | 11.2 |
| 1774D | .71 | 27.9 | .69 | 11.6 | 0 | 0 | 9.7. |
| 1774E | .71 | 27.8 | .68 | 12.5 | 0 | 0 | 15.1 |
| 1775A | .69 | 27.0 | .30 | 10.9 | 0 | 0 | 13.9 |
| 1775B | .70 | 28.1 | .54 | 10.9 | 0 | 0 | 14.5 |
| 1775C | .71 | 29.3 | .88 | 10.7 | 0 | 0 | 9.6 |
| 17741 | .66 | 25.5 | .66 | 10.2 | 0 | 0 | 17.3 |
| 17742 | .58 | 25.2 | .66 | 9.9 | 0 | 0 | 16.4 |
| 17743 | .74 | 27.9 | .66 | 9.6 | 0 | 0 | 8.3 |
| 17752 | .77 | 27.2 | .29 | 7.0 | 0 | 0 | 1.8 |
| 17753 | .73 | 26.5 | .29 | 9.9 | 0 | 0 | 10.1 |
| 1825 | .55 | 27.4 | .48 | 11.7. | 0 | 0 | 7.9 |
| 1826 | .61 | 27.9 | .49 | 11.7 | 0 | 0 | 5.6 |
| 1827 | .60 | 28.1 | .55 | 11.9 | 1.80 | 1.80 | 4.2 |
| 1828 | .61 | 28.4 | .56 | 11.8 | 1.93 | 2.80 | 3.8 |
| 1829 | .63 | 28.2 | .55 | 11.9 | 1.94 | 3.75 | 2.8 |
| 1830 | .66 | 28.4 | .54 | 11.9 | 1.96 | 4.66 | 1.1 |
| 1880A | .81 | 29.5 | .32 | 7.9 | 0 | 0 | 0 |
| 1880D | .81 | 29.3 | .34 | 8.7 | 0 | 1.1 | 2.5 |
| 1880E | .80 | 29.0 | .35 | 9.6 | 0 | 2.3 | 4.1 |
| 1881A | .76 | 29.3 | .34 | 7.5 | 0 | 0 | 0.7 |
| 1881B | .76 | 29.3 | .75 | 7.5 | 0 | 0 | 2.0 |
| 1881C | .75 | 28.9 | 1.19 | 7.5 | 0 | 0 | 1.4 |
| 1881D | .76 | 28.6 | 1.19 | 7.3 | 0 | 2.1 | 4.6 |
| 1882A | .82 | 29.1 | .54 | 9.8 | 0 | 0 | 2.6 |
| 1882D | .81 | 28.8 | .54 | 9.6 | 0 | 0 | 2.8 |
| 1882E | 1.06 | 29.5 | .54 | 9.2 | 0 | 0 | 1.6 |
| 1882F | 1.24 | 29.3 | .56 | 9.2 | 0 | 0 | 1.7 |

The elements and the composition ranges of the elements selected to produce the data of Table 1 were chosen based upon studies reported in the literature and on the effects of these elements on the critical properties of density, strength, corrosion resistance, formability and weldability. The heats numbered 1232° to 1882° F. were either 50 or 70 kg in weight, cast into approximately 3½ inches or 5 inches square ingots respectively. Samples cast simultaneously with the ingots were analyzed for composition and studied microscopically and magnetic measurements made for determination of the volume percent ferrite (VPF) resulting from the various compositions. The ingots were generally hot rolled to a thickness of about 0.25 inches on a laboratory mill equipped to allow measurement of the rolling energy requirements of the various alloys. Selected heats were further cold rolled to 0.10 inch thickness. Some of the compositions melted could not be hot rolled because of the presence of excess ferrite. Heating temperatures for these operations were in the range of 1560° F. (850° C.) to 2150° F. (1175° C.). No difficulty was encountered hot working heats having a VPF in the range of 1 percent to 8 percent.

From an analysis of the data from Table 1, a relationship was ascertained on the basis of which a quantitative prediction of VPF can be made as a linear function of the carbon, manganese, silicon, aluminum, chromium and nickel weight percentages in the alloys as follows:

$$1<\mathrm{VPF}=33+2.6(\mathrm{Al}\%)+5.4(\mathrm{Si}\%)-1.6(\mathrm{Mn}\%)-8.5(\mathrm{C}\%)-4.6(\mathrm{Cr}\%)-1.2(\mathrm{Ni}\%)<8$$

where Al%, Si%, Mn%, C%, Cr% and Ni% are selected percentages by weight of aluminum, silicon, manganese, carbon, chromium and nickel respectively present in the alloy, the balance of composition of the alloy being essentially iron, and where VPF is the volume percent of ferrite structure. This equation relates the independent composition variables to the dependent variable of the volume fraction of ferrite to be found in the surface of an as-cast section of the alloy such as an ingot or cast slab that has been cooled without undue delay to below 600° F. (315° C.). The applicant has found that alloys having an acceptable level of ferrite, as calculated from the aforementioned formula, and which at the same time have composition levels of individual elements that do not go beyond known alloying restraints can be made, comprising by weight 6 to 13 percent aluminum, 7 to 34 percent manganese, 0.2 to 1.4 percent carbon, 0.4 to 1.3 percent silicon, 0.5 to 6 percent chromium and 0.5 to 6 percent nickel. Within these ranges, the following narrower ranges are preferred: 6 to 12 percent aluminum, 10 to 31 percent manganese, 0.4 to 1.2 percent carbon, 0.4 to 1.3 percent silicon, 0.5 to 5 percent chromium and 0.5 to 4.5 percent nickel. The proportions of these alloying elements are selected from these ranges according to the aforementioned formula to result in between 1 percent and 8 percent VPF in an otherwise austenitic crystal structure.

The foregoing formula should be applied not exactly but rather within analytical tolerances which take into account the expected analytical variability in determining the composition of the allows. An empirical version of the foregoing formula duly taking into account tolerances is as follows:

$$1 < VPF = 33 + 2.6(\mathrm{Al}\% \pm .08) + 5.4(\mathrm{Si}\% \pm .03) - 1.6(\mathrm{Mn}\% \pm .16) - 8.5(\mathrm{C}\% \pm .03) - 1.2(\mathrm{Ni}\% \pm .15) - 4.6(\mathrm{Cr}\% \pm .17) < 8$$

where all the symbols are as previously defined.

Corrosion resistant alloys may be made using either chromium or nickel or both together. The above formula is applicable in all three cases. If chromium alone is selected so that nickel is not present, or is present only in small quantities as an impurity, then the formula is modified simply by dropping the term for nickel. It would therefore read:

$$1<\mathrm{VPF}=33+2.6(\mathrm{Al}\%)+5.4(\mathrm{Si}\%)-1.6(\mathrm{Mn}\%)-8.5(\mathrm{C}\%)-4.6(\mathrm{Cr}\%)<8.$$

Likewise nickel alone can be selected, so that chromium is not present, or is present only in small quantities as an impurity. The formula would then be modified by dropping the term for chromium, to read:

$$1<\mathrm{VPF}=33+2.6(\mathrm{Al}\%)+5.4(\mathrm{Si}\%)-1.6(\mathrm{Mn}\%)-8.5(\mathrm{C}\%)-1.2(\mathrm{Ni}\%)<8.$$

The above-stated ranges for the remaining elements remain the same where only chromium, but not nickel, is used in the alloy. Where only nickel, but not chromium, is used the range for manganese is 17–34 percent, with a preferred range of 19–34 percent.

The manufacture of alloys according to the invention commences with the calculation of a composition according to the above formula to ensure that an acceptable level of ferrite is present in the crystal structure. Within the constraints imposed by that formula, the composition is also controlled to achieve the desired characteristics of strength, toughness, formability and corrosion resistance.

Manganese concentrations in excess of about 30 percent tend to cause the formation of embrittling beta manganese phase. Carbon is excess of about 1.0 percent has been shown to have a detrimental effect on corrosion resistance. Silicon in excess of about 1.3 percent has been found to result in cracking during rolling. These additional known restraints and limitations upon the contributions to alloy composition of particular elements are indicated here to illustrate the effects influencing the design of useful alloys, but are not intended to be exclusive of other effects taught in the literature or other prior art.

Owing to the exceptionally high manganese content required in these alloys, the only reasonable economic source of manganese is the common ferromanganese alloys. These ferro alloys characteristically contain maximum phosphorus levels of the order of 0.30 to 0.35 percent. Since it is impractical to remove phosphorus during melting in this alloy system, the resulting iron-manganese-aluminum alloys melted with these raw materials will have levels of phosphorus in the range of 0.03 to 0.11 percent by weight, typical levels being about 0.045 to 0.055 percent. These levels of phosphorus have an insignificant effect on the aforementioned formula. Alloys according to the invention may also contain small amounts of other elements as a consequence of the raw materials used in commercial melting.

When a composition of alloy has been selected to achieve the desired ferrite-austenite ratio in accordance with the calculation above, the melt is heated up to about 2550° to 2650° F. (1400° to 1450° C.) at which temperature the alloy is molten. Alloys according to the invention can be melted by standard techniques, such as by the electric arc or induction furnace method, and may be optionally further processed through any of the "second vessel" practices used in conventional stainless steel making.

The alloy is poured into an ingot mould and permitted to cool at ambient temperature for two and one-half to three hours in order to solidify. Solidification commences at just above 2490° F. (1365° C.) and is complete at about 2170° F. (1190° C.), the exact temperatures of melting and solidification being dependent upon the elemental composition. The mould is then stripped from the ingot and the ingot may be further cooled or charged hot for reheating to be further worked as required. Alternatively, alloys according to the invention can be continuously cast to slabs on conventional machines and reheated and hot rolled according to usual industry practices for stainless steels.

Alloys according to the present invention present none of the phase change problems which have characterized earlier compositions. As long as the ferrite percentage as described above is kept within the range of about 1 percent to about 8 percent, the ingot can be hot worked and the coil product cold worked without adverse results. Hot rolling of these alloys can be readily accomplished on mills conventionally used for the processing of austenitic steels. However, the lower melting point resulting from the higher total alloy content of compositions according to the invention must be recognized in the selection of a heating temperature for the ingots or slabs. Typically, 2150° F. (1175° C.) has proved satisfactory for the alloys near the mid-range of the composition constraints of the invention.

Alloys according to the invention can be successfully cold rolled if desired and tend to behave in response to temperature conditioning as do conventional austenitic stainless steels.

As stated above, it has been found that alloys made in accordance with the present invention, having a VPF between 1 and 8, have good hot rollability. It has also been found that the weldability (i.e. spot-, resistance- or arc-welding) of such alloys is also dependent on the VPF. In particular, adverse weldability effects have been found where the VPF is outside the range between about 2 and 12. Thus, where good weldability is desired as a characteristic of alloys made in accordance with this invention, the VPF should be controlled within the range of between 2 and 8, values of 2 or less being unsatisfactory for weldability and values of 8 and over being unsatisfactory for hot rollability. The foregoing formula is used in the selection of the proportions of alloying elements, but the lower limit for VPF is 2 instead of 1.

We claim:

1. A substantially austenitic stainless steel alloy having a predetermined volume percent of ferrite structure in the range of about 1 percent to about 8 percent, said alloy comprising by weight about 6 to about 13 percent aluminum, about 7 to about 34 percent manganese, about 0.2 to about 1.4 percent carbon, about 0.4 to about 1.3 percent silicon, about 0.5 to about 6 percent chromium, about 0.5 to about 6 percent nickel, and the balance comprising iron, wherein the proportions of the elements alloyed with iron are selected from said ranges satisfy the formula $$1 < VPF = 33 + 2.6(Al\ \% \pm .08) + 5.4(Si\ \% \pm .03) - 1.6(Mn\ \% \pm .16) - 8.5(C\ \% \pm .03) - 1.2(Ni\ \% \pm .15) - 4.6(Cr\ \% \pm .17) < 8$$

or substantial metallurgical equivalent thereof, where Al%, Si%., Mn%. C%, CR% and Ni% are selected percentages by weight of aluminum, silicon, manganese, carbon, chromium and nickel respectively present in said alloy, and where VPF is the volume percent of ferrite structure.

2. A substantially austenitic stainless steel alloy as defined in claim 1 wherein said percentages by weight are selected from the ranges of about 6 to about 12 percent aluminum, about 10 to about 31 percent manganese, about 0.4 to about 1.2 percent carbon, about 0.4 to about 1.3 percent silicon, about 0.5 to about 5 percent chromium, and about 0.5 to about 4.5 percent nickel, respectively.

3. A substantially austenitic stainless steel alloy having a predetermined volume percent of ferrite structure in the range of about 1 percent to about 8 percent, said alloy comprising by weight about 6 to about 13 percent aluminum, about 7 to about 34 percent manganese, about 0.2 to about 1.4 percent carbon, about 0.4 to about 1.3 percent silicon, and about 0.5 to about 6 percent chromium, and the balance comprising iron, wherein the proportions of the elements alloyed with iron are selected from said ranges satisfy the formula $$1 < VPF = 33 + 2.6(Al\% \pm 0.08) + 5.4\ (Si\% \pm 0.03) - 1.6(Mn\% \pm 0.16) - 8.5(C\% \pm 0.03) - 4.6(Cr\% \pm 0.17) < 8$$

or substantial metallurgical equivalent thereof, where Al%, Si%, Mn%, and Cr% are selected percentages by weight of aluminum, silicon, manganese, carbon, and chromium respectively present in said alloy, and where VPF is the volume percent of ferrite structure.

4. A substantially austenitic stainless steel alloy as defined in claim 3 wherein said percentages by weight are selected from the ranges of about 6 to about 12 percent aluminum, about 10 to about 31 percent manganese, and about 0.4 to about 1.2 percent chromium, respectively.

5. A method of making a substantially austenitic stainless steel alloy having a predetermined volume percent of ferrite structure in the range of about 1 percent to about 8 percent, comprising the steps of:

(a) selecting proportions of aluminum, manganese, carbon, silicon, chromium and nickel to satisfy the formula $$1 < VPF = 33 + 2.6(Al\ \% \pm .08) + 5.4(Si\ \% \pm .03) - 1.6(Mn\ \% \pm .16) - 8.5(C\ \% \pm .03) - 1.2(Ni\ \% \pm .15) - 4.6(Cr\ \% \pm .17) < 8$$

or substantial metallurgical equivalent thereof, where Al%, Si%, Mn%, C%, Cr% and Ni% are selected percentages by weight of aluminum, silicon, manganese, carbon, chromium, and nickel, respectively, and where VPF is the volume percent of ferrite structure, said percentages by weight being selected from the ranges of about 6 to about 13 percent aluminum, about 7 to about 34 percent manganese, about 0.2 to about 1.4 percent carbon, about 0.4 to about 1.3 percent silicon, about 0.5 to about 6 percent chromium, and about 0.5 to about 6 percent nickel, the balance of the alloy comprising iron, and (b) alloying the selected proportions of aluminum, silicon, manganese, carbon, chromium, nickel and iron.

6. A method according to claim 5, wherein said percentages by weight of aluminum, manganese, carbon, silicon, chromium and nickel are selected from the ranges of about 6 to about 12 percent aluminum, about 10 to about 31 percent manganese, about 0.4 to about 1.2 percent carbon, about 0.4 to about 1.3 percent silicon, about 0.5 to about 5 percent chromium, and about 0.5 to about 4.5 percent nickel, respectively.

7. A method of making a substantially austenitic stainless steel alloy having a predetermined volume percent of ferrite structure in the range of about 1 percent to about 8 percent, comprising the steps of:

(a) selecting proportions of aluminum, manganese, carbon, silicon and chromium to satisfy the formula $$1<VPF=33+2.6(Al\% \pm 0.08)+5.4\,(Si\% \pm 0.03)-1.6(Mn\% \pm 0.16)-8.5(C\% \pm 0.03)-4.6(Cr\% \pm 0.17)<8$$

or substantial metallurgical equivalent thereof, where Al%, Si%, Mn%, C%, and Cr% are selected percentages by weight of aluminum, silicon, manganese, carbon, and chromium, respectively, and where VPF is the volume percent of ferrite structure, said percentages by weight being selected from the ranges of about 6 to about 13 percent aluminum, about 7 to about 34 percent manganese, about 0.2 to about 1.4 percent carbon, about 0.4 to about 1.3 percent silicon, about 0.5 to about 6 percent chromium, the balance of the allow comprising iron; and (b) alloying the selected proportions of aluminum, silicon, manganese, carbon, chromium, and iron.

8. A method according to claim 7, wherein said selected percentages by weight of aluminum, manganese, carbon, silicon, and chromium are selected from the ranges of about 6 to about 12 percent aluminum, about 10 to about 31 percent manganese, about 0.4 to about 1.2 percent carbon, about 0.4 to about 1.3 percent silicon, and about 0.5 to about 5 percent chromium, respectively.

9. A substantially austenitic stainless steel alloy as defined in claim 1 wherein the predetermined volume percent of ferrite structure is in the range of about 2 percent to about 8 percent, and wherein the proportions of the elements alloyed with iron selected from said ranges satisfy the formula $$2 < VPF = 33 + 2.6(Al\% \pm .08) + 5.4(Si\% \pm .03) - 1.6(Mn\% \pm .16) - 8.5(C\% \pm .03) - 1.2(Ni\% \pm .15) - 4.6(Cr\% \pm .17) < 8$$

or substantial metallurgical equivalent thereof.

10. A substantially austenitic stainless steel alloy as defined in claim 9 wherein the percentages by weight are selected in the ranges of about 6 to about 12 percent aluminum, about 10 to about 31 percent manganese, about 0.4 to about 1.2 percent carbon, about 0.4 to about 1.3 percent silicon, about 0.5 to about 5 percent chromium, and about 0.5 to about 4.5 percent nickel, respectively.

11. A substantially austenitic stainless steel alloy as defined in claim 3 wherein the predetermined volume percent of ferrite structure is in the range of about 2 percent to about 8 percent and wherein the proportions of the elements alloyed with iron are selected from said ranges satisfy the formula $$2<VPF=33+2.6(Al\% \pm 0.08)+5.4\,(Si\% \pm 0.03)-1.6(Mn\% \pm 0.16)-8.5(C\% \pm 0.03)-4.6(Cr\% \pm 0.17)<8$$

or substantial metallurgical equivalent thereof.

12. A substantially austenitic stainless steel alloy as defined in claim 11 wherein the percentages by weight are selected from the ranges of about 6 to about 12 percent aluminum, about 10 to about 31 percent manganese, about 0.4 to about 1.2 percent carbon, about 0.4 to about 1.3 percent silicon, and about 0.5 to about 5 percent chromium, respectively.

13. A method according to claim 5 wherein the predetermined volume percent of ferrite structure is in the range of about 2 percent to about 8 percent, further comprising the step of selecting proportions of aluminum, manganese, carbon, silicon, chromium, and nickel to satisfy the formula $$2 < VPF = 33 + 2.6(Al\% \pm .08) + 5.4(Si\% \pm .03) - 1.6(Mn\% \pm .16) - 8.5(C\% \pm .03) - 1.2(Ni\% \pm .15) - 4.6(Cr\% \pm .17) < 8$$

or substantial metallurgical equivalent thereof.

14. A method according to claim 13, wherein said percentages by weight of aluminum, manganese, carbon, silicon, chromium, and nickel are selected from the ranges of about 6 to about 12 percent aluminum, about 10 to about 31 percent manganese, about 0.4 to about 1.2 percent carbon, about 0.4 to about 1.3 percent silicon, about 0.5 to about 5 percent chromium, and about 0.5 to about 4.5 percent nickel, respectively.

15. A method according to claim 7 wherein the predetermined volume percent of ferrite structure is in the range of about 2 percent to about 8 percent, further comprising the step of selecting proportions of aluminum, manganese, carbon, silicon, and chromium to satisfy the formula $$2<VPF=33+2.6(Al\% \pm 0.08)+5.4\,(Si\% \pm 0.03)-1.6(Mn\% \pm 0.6)-8.5(C\% \pm 0.03)-4.6(Cr\% \pm 0.17)<8$$

or substantial metallurgical equivalent thereof.

16. A method according to claim 15, wherein said selected percentages by weight of aluminum, manganese, carbon, silicon, and chromium are selected from the ranges of about 6 to about 12 percent aluminum, about 10 to about 31 percent manganese, about 0.4 to about 1.2 percent carbon, about 0.4 to about 1.3 percent silicon, and about 0.5 to about 5 percent chromium, respectively.

* * * * *

UNITED STATES PATENT AND TRADEMARK OFFICE

CERTIFICATE OF CORRECTION

PATENT NO. : 4,865,662

DATED : September 12, 1989

INVENTOR(S) : James M. Zimmer et al.

It is certified that error appears in the above-identified patent and that said Letters Patent is hereby corrected as shown below:

Column 2, line 63, after "nickel" insert --, if nickel is present,--

Column 6, lines 8-9, delete "using either chromium or nickel or both together" and insert therefor --with or without nickel--

Column 10, line 9, "are" should be deleted

Signed and Sealed this

Eighth Day of October, 1991

*Attest:*

HARRY F. MANBECK, JR.

*Attesting Officer*

*Commissioner of Patents and Trademarks*